US008377227B2

(12) United States Patent
Bengston et al.

(10) Patent No.: US 8,377,227 B2
(45) Date of Patent: Feb. 19, 2013

(54) UTENSIL HOLDER FOR A DISHWASHER

(75) Inventors: Debra L. Bengston, Jackson, TN (US); Mark Britton, Portland, OR (US); Heather Hagans, Jackson, TN (US); Scott D. Raches, Jackson, TN (US); Wayne M. VanLandingham, Texarkana, TX (US); Christopher W. Vaughn, Mebane, NC (US); Karl R. C. Wendt, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 1882 days.

(21) Appl. No.: 11/113,968

(22) Filed: Apr. 26, 2005

(65) Prior Publication Data

US 2006/0237053 A1 Oct. 26, 2006

(51) Int. Cl.
*B08B 3/02* (2006.01)

(52) U.S. Cl. ..... 134/56 D; 134/135; 134/201

(58) Field of Classification Search ..... 134/56 D, 134/57 D, 58 D, 135, 201; 211/70.7, 87.01
See application file for complete search history.

(56) References Cited

U.S. PATENT DOCUMENTS

| | | | | | |
|---|---|---|---|---|---|
| 3,665,943 | A | * | 5/1972 | Lampman et al. | 134/200 |
| 3,732,876 | A | | 5/1973 | Braga et al. | |
| 4,174,486 | A | * | 11/1979 | Winkler | 312/321.5 |
| 4,834,125 | A | | 5/1989 | Insalaco | |
| 5,069,360 | A | * | 12/1991 | Dingler et al. | 220/501 |
| 5,431,294 | A | | 7/1995 | Stottmann et al. | |
| 6,161,718 | A | | 12/2000 | Monbo | |
| D487,825 | S | * | 3/2004 | Kim et al. | D32/3 |
| D488,891 | S | * | 4/2004 | Smith et al. | D32/3 |
| D502,295 | S | * | 2/2005 | Feddema | D32/3 |
| 2002/0139809 | A1 | | 10/2002 | Barry et al. | |
| 2004/0094555 | A1 | * | 5/2004 | Raches et al. | 220/476 |
| 2005/0045215 | A1 | | 3/2005 | Raches et al. | |

FOREIGN PATENT DOCUMENTS

| | | | |
|---|---|---|---|
| EP | 0 697 187 A1 | | 2/1996 |
| JP | 6100041 | | 4/1994 |
| JP | 2001-112695 | * | 4/2001 |

* cited by examiner

*Primary Examiner* — Joseph L Perrin
(74) *Attorney, Agent, or Firm* — Jacquelyn R. Lin; Diederiks & Whitelaw PLC

(57) ABSTRACT

A utensil holder for use in a dishwasher includes a basket including front, rear, bottom and opposing side walls, as well as an upper opening. The rear wall has a height greater than the front wall. A lid member, having a support surface across which are arrayed a plurality of openings, is secured across the upper opening. The plurality of openings receive and arrange utensils to be exposed to a washing operation. A handle member, including first and second upstanding portions interconnected through a cross bar portion, extends from the basket. The cross bar portion includes angled sections that enable a gripping section to be offset. The utensil holder is designed to mount in various configurations to an inner liner of a dishwasher door, or alternatively be supported on a rack in the dishwasher.

22 Claims, 8 Drawing Sheets

UTENSIL HOLDER FOR A DISHWASHER

BACKGROUND OF THE INVENTION

1. Field of the Invention

The present invention pertains to the art of dishwashers and, more particularly, to a utensil holder having a slanted lid member that can be mounted in various positions on a door or suspended on a rack in the dishwasher.

2. Discussion of the Prior Art

In general, dishwashers are designed to wash/sanitize dishware, cookware and utensils used in the preparation and consumption of food. Toward that end, a typical dishwasher includes a wash chamber, a pump assembly for generating a washing fluid flow in the wash chamber and at least one rack for supporting articles to be cleaned. The dishwasher also includes a door that seals across the wash chamber to prevent washing fluid from escaping during a wash operation. In most cases, the door will have an outer decorative shell designed to blend in with surrounding cabinetry and an inner liner which carries detergent and water conditioning dispensers. Typically, items such as dishware, bakeware, glassware and the like are supported on the rack(s) during the washing operation, while smaller items such as silverware and utensils are placed in a basket for washing.

In most cases, the basket is supported on a lower rack of the dishwasher. Silverware and other utensils placed in the basket are exposed to a spray of washing fluid during the washing operation. Some baskets are fixedly mounted to racks, while others are removable so as to allow positioning in various locations in the dishwasher, as well as facilitate the unloading of utensils. In this manner, the basket can be placed in a location to allow for specific placement of dishware, or removed all together to accommodate larger items such as bowls and baking dishes. However, while larger items or loads can be washed by removing the basket, a separate cycle will then be required to wash the utensils or wash larger items, or these items will need to be washed by hand.

As an alternative to baskets supported by or affixed to the rack, some dishwashers mount the utensil baskets to inner liners of doors. The baskets can either be formed as part of the inner liner, or designed to be removed to facilitate unloading the contents at a remote location. Baskets that are formed as part of the inner liner can be awkward to load. In addition, when the door is simultaneously supporting a rack, the basket is not readily accessible. Baskets that are removably mounted to the door typically do not clean flatware as well as rack mounted baskets, with the drawback being attributed to the designs employed in the prior art. In any event, while both designs possess certain advantages, both designs also have their respective drawbacks. In addition, currently available utensil baskets typically allow a consumer to lump as many knives, forks and spoons as will fit into various compartments of the basket. If not properly arranged or at least loosely positioned in the basket, the spray of washing fluid can impact only a portion of the utensil in the basket, leaving the remainder unwashed. Baskets that force an ordered arrangement, maintain all the utensils at one, substantially horizontally plane. By supporting the utensils in a substantially horizontal plane, not all of the utensils can be uniformly exposed to the spray of washing fluid. Thus, only a portion of the utensils are adequately washed.

Therefore, despite the existence of utensil baskets in the prior art, there still exists a need for a utensil basket incorporating a flexible mounting arrangement for use in a dishwasher. More specifically, there exists a need for a utensil basket that can be either door mounted or supported on a rack.

In addition, the basket should support the utensils in such as manner as to maximize exposure to a washing fluid spray.

SUMMARY OF THE INVENTION

The present invention is directed to a utensil holder for use in a dishwasher. The dishwasher includes a wash chamber, a door for selectively sealing the wash chamber and a rack. The door includes an outer, decorative shell and an inner liner. In accordance with the invention, the utensil holder can either be mounted to the inner liner of the door or supported upon the rack. More specifically, the utensil holder includes a basket having front, rear, bottom and opposing side walls, as well as a lid member adapted to extend across an upper opening of the basket. The rear wall is formed so as to have a height greater than the front wall so that the lid member slopes downward from back to front.

In accordance with the most preferred form of the invention, the lid member is snap-fittingly secured across the upper opening. The lid member includes a support surface that conforms to the various walls of the basket. The lid member also includes a plurality of openings that extend across the support surface for receiving utensils. Preferably, the openings are constituted by elongated slots that enable the lid member to accommodate a variety of different utensil styles. The utensil holder is provided with a handle member that enables a consumer to readily remove and carry the basket from the dishwasher. The handle member includes first and second upstanding portions that are interconnected through a cross bar portion. The cross bar portion preferably incorporates first and second angled sections that establish a gripping section that is offset from the upstanding portions. The gripping section provides an ergonomic means of grasping and removing the utensil holder from the dishwasher.

In a preferred form of the invention, the plurality of openings are arranged in rows that extend longitudinally across the support surface. The plurality of openings are also arranged in a pattern so as to define a plurality of zones, including first and second outer zones and a central zone. Actually, the zones correspond to various compartments defined by internal dividers that extend from the front wall toward the rear wall of the basket.

In further accordance with the most preferred form of the invention, the utensil holder includes a plurality of mounting elements that are provided on the rear wall of the basket. The mounting elements are arranged so as to matingly engage with corresponding mounting members provided on the inner liner of the door. Actually, the mounting members are arranged so as to define various mounting zones across the inner liner. More specifically, the mounting members are spaced so as to define a left mounting zone, a center mounting zone and a right mounting zone. With this arrangement, the utensil holder can be selectively located according to the preferences of a consumer. Actually, the mounting members are formed so as to advantageously enable two utensil holders to be mounted to the inner liner in a side-by-side configuration or individually in the various mounting zones.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
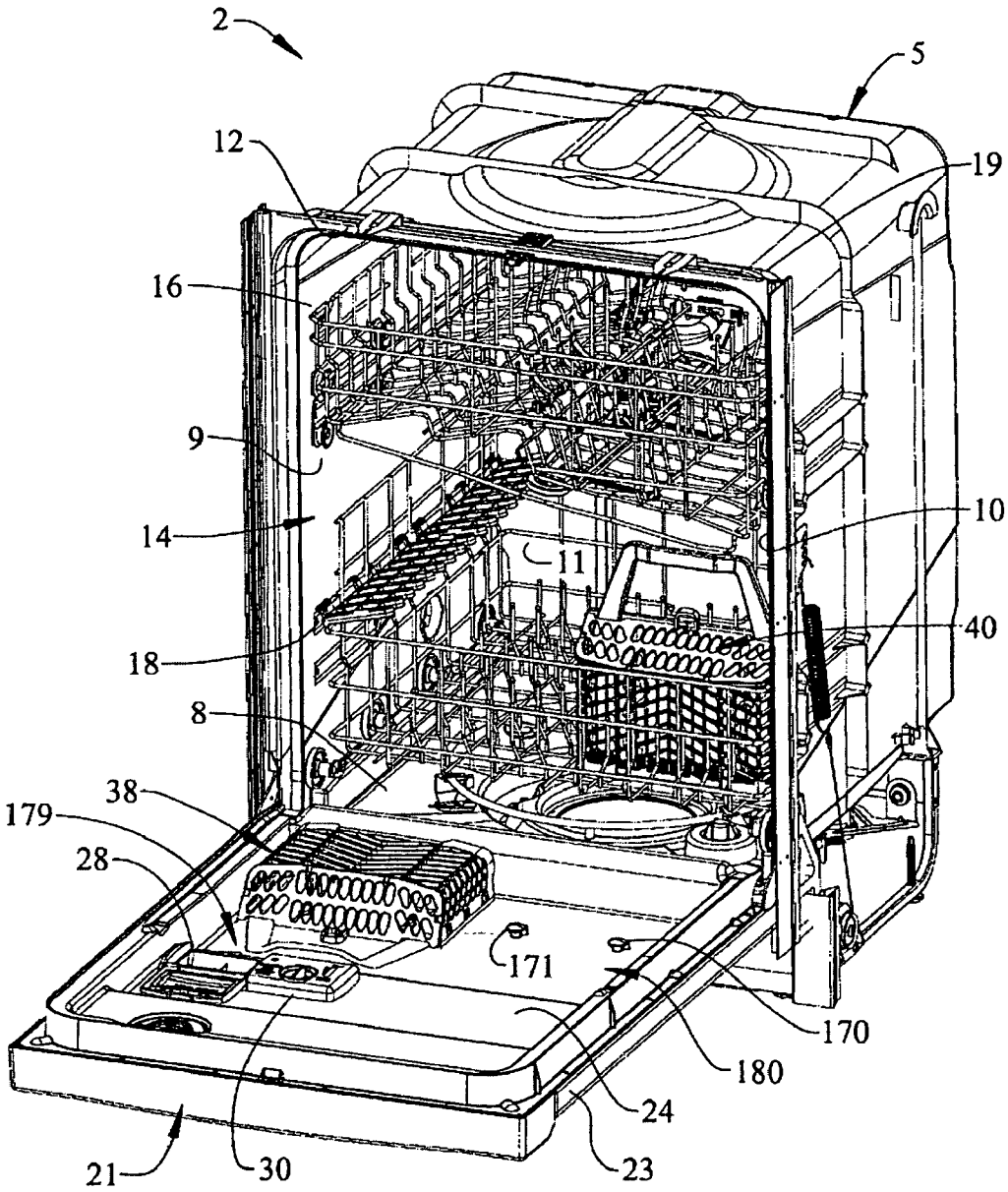
FIG. 1 is an upper right perspective view of a dishwasher incorporating a utensil holder constructed in accordance with the present invention.

With initial reference to FIG. 1, a dishwasher constructed in accordance with the present invention is generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon shiftable upper and lower racks 16 and 18, with the kitchenware being cleaned during a washing operation in a manner widely known in the art.

Tub 5 has attached thereto a frontal frame 19 which pivotally supports a door 21 used to seal washing chamber 14 during a washing operation. In a manner known in the art, door 21 includes an outer, decorative panel 23 and an inner liner 24. In the embodiment shown, door 21 is preferably provided with a detergent tray assembly 28 that is mounted to inner liner 24. In connection with the washing operation, a consumer can place liquid or particulate washing detergent in detergent tray assembly 28 for dispensing at predetermined portions of the washing operation. Positioned adjacent detergent tray assembly 28 is a conditioner dispenser 30. Of course, dispensing detergent and/or conditioner in this fashion is known in the art such that this arrangement is only being described for the sake of completeness.

As shown, dishwasher 2 is provided with two utensil holders 38 and 40 for supporting silverware and the like in washing chamber 14 during a washing operation. As will be detailed more fully below, utensil holders 38 and 40 can be supported upon rack 18 or, on inner liner 24 of door 21. As each utensil holder 38 and 40 is identical, a detailed description will be made with respect to utensil holder 38, with an understanding that utensil holder 40 has corresponding structure.

As best shown in FIGS. 2-5, utensil holder 38 includes a basket 44 having front, rear, opposing side and bottom walls 46-50. In a manner known in the art, front wall 46, side walls 48 and 49, and bottom wall 50 are molded of plastic having an open lattice work such that washing fluid can enter into basket 44 and impinge upon utensils contained therein. Conversely, rear wall 47 is preferably constituted by a substantially solid web of, for example, molded plastic. In any event, front wall 46, rear wall 47 and side walls 48 and 49 collectively define an upper opening 51. In the most preferred form of the invention, rear wall 47 has an associated height which is greater than front wall 46.

In accordance with the invention, basket 44 is provided with a plurality of dividers 60 and 61 that project substantially perpendicularly from front wall 46. Dividers 60 and 61 define a plurality of storage zones or compartments 63-65 for separating utensils during an overall washing process. That is, basket 44 includes first and second outer storage compartments 63 and 64, as well as a central storage compartment 65. In further accordance with the invention, front wall 46, side walls 48 and 49, bottom wall 50 and dividers 60 and 61 are integrally molded so as to form a unitary basket assembly 67 that is connected to rear wall 47.

As best illustrated in FIGS. 3-11, side walls 48 and 49 include a plurality of catch members, such as indicated at 70-72 on wall 49. A corresponding plurality of catch members, two of which are indicated at 75 and 76, are provided on side wall 48. Catch members 70-72 and 75-76 are adapted to interconnect with a respective plurality of tab elements 80-82 and 84-86 projecting from rear wall 47. Each tab element 80-82 and 84-86 is formed with an angled locking member, one of which is indicated at 87. In addition, in order to form a more robust connection, dividers 60 and 61 are also provided with hook elements indicated at 90 and 91 that are adapted to project through corresponding openings 93 and 94 and engage rear wall 47. Likewise, bottom wall 50 is provided with hook elements 96 and 97 (FIG. 5) that releasably lock into notches 98 and 99 provided on a bottom edge portion (not separately labeled) of rear wall 47 as detailed fully below.

Figure 8:
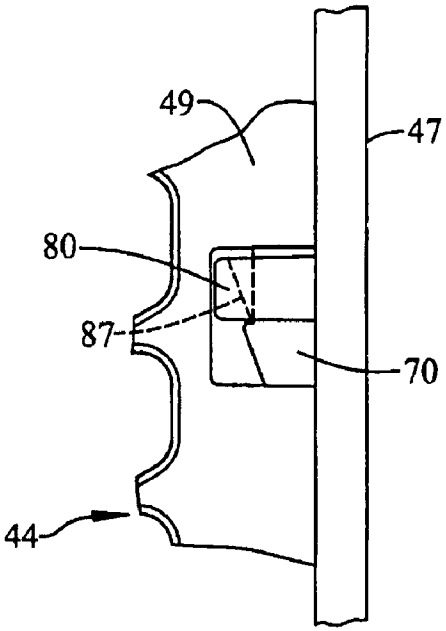
FIG. 8 is an enlarged, detail view illustrating relative shifting between the tab element and the catch member, locking the basket assembly to the rear wall.
Figure 7:
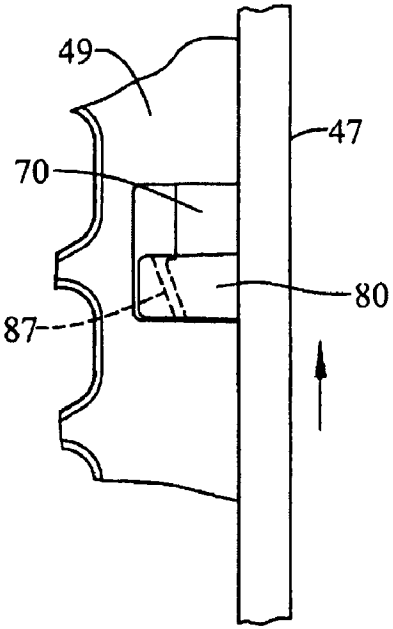
FIG. 7 is an enlarged, detailed view illustrating the catch member receiving the tab element.
Figure 6:
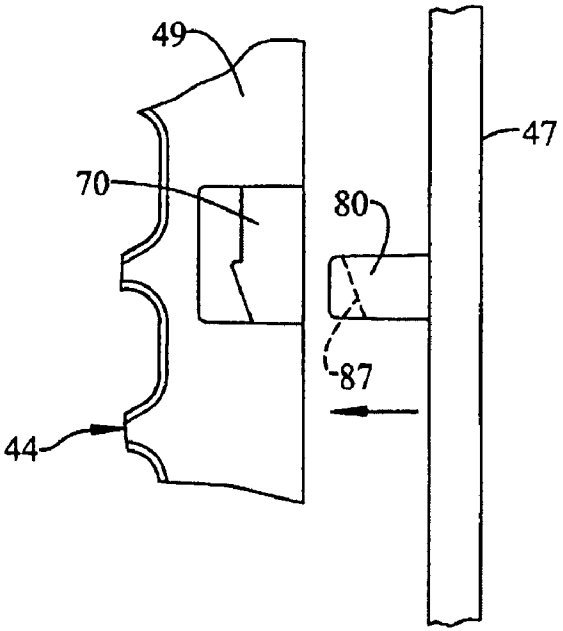
FIG. 6 is an enlarged detail view illustrating a catch member provided on side portion of the utensil holder basket and a tab element provided on a back portion of the utensil holder.
Figure 11:
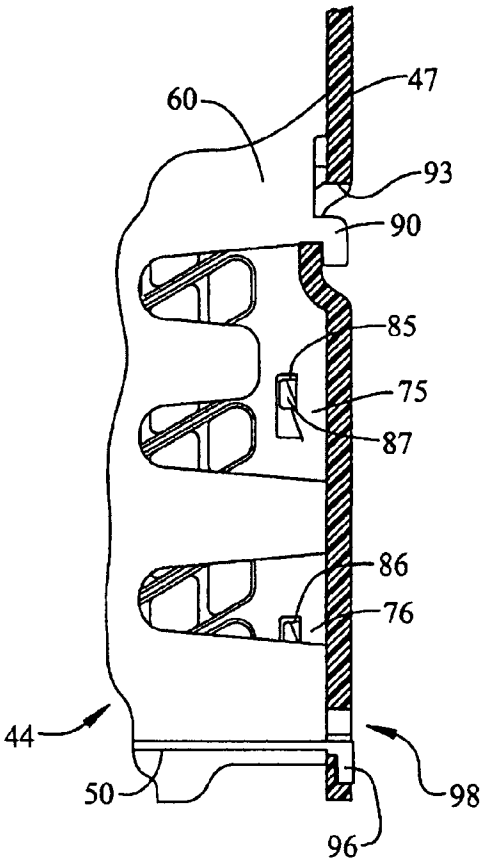
FIG. 11 is partial, cross sectional view of the basket of FIG. 8 shifted relative to the back portion so as to form the utensil holder.
Figure 10:
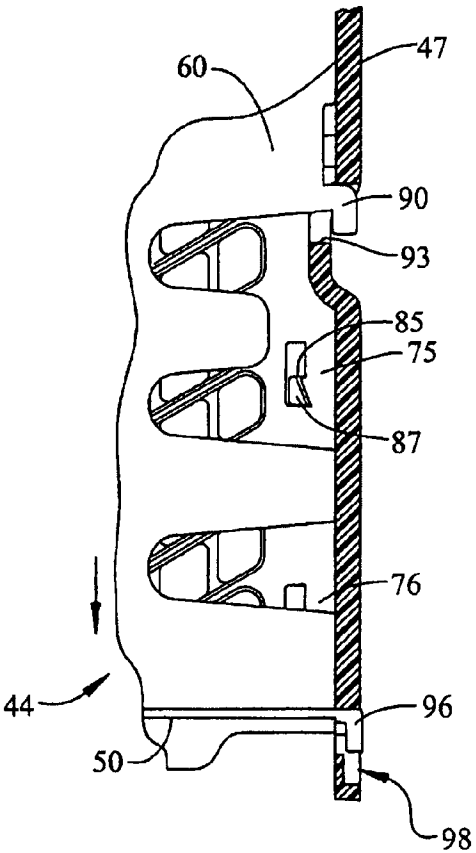
FIG. 10 is partial, cross sectional side view illustrating the basket mated to the back portion of the utensil holder.
Figure 9:
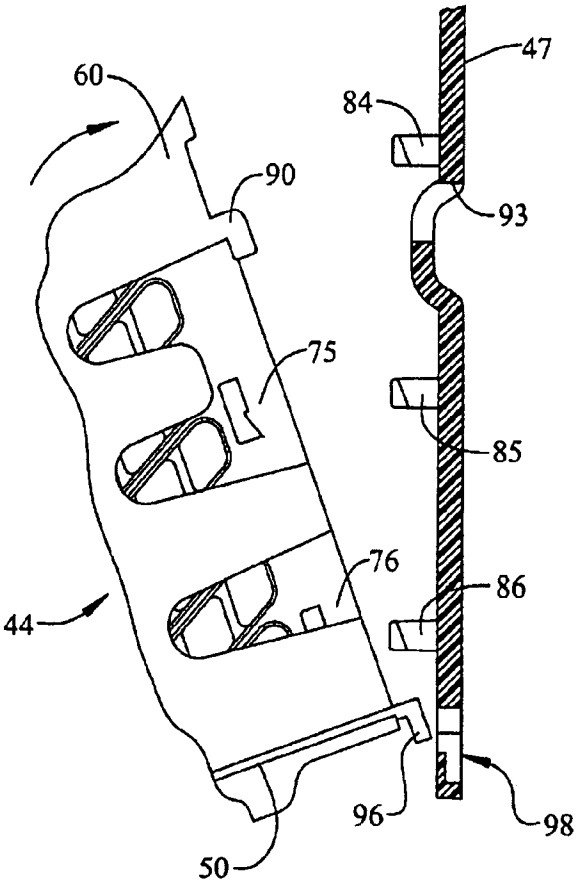
FIG. 9 is a partial, cross sectional side view illustrating a basket connecting to a back portion of the utensil holder of the invention.

To interconnect unitary basket assembly 67 to rear wall 47 in order to form the overall basket 44, unitary basket assembly 67 is oriented relative to rear wall 47 such that tab elements 80-82 and 84-86 respectively align with catch members 70-72 and 75-76, hook elements 90-91 on dividers 60 and 61 align with opening 93 and 94, and hook elements 96 and 97 aligns with notches 98 and 99 as illustrated from the positions shown in FIGS. 6 and 9 to the position shown in FIGS. 7 and 10. At this point, unitary basket assembly 67 is connected to rear wall 47 such that tab elements 80-82 and 85-86 are positioned at catch members 70-72 and 75-76, hook elements 90-91 project through openings 93 and 94, and hook members 96 and 97 extend into notches (FIGS. 7 and 10). Basket assembly 67 and rear wall 47 are relatively shifted so as to detachably interlock so as to form utensil holder 38 (FIGS. 8 and 11). More specifically, each locking member 87 on tab elements 80-82 and 84-86 rides along and past a ramped surface 100 provided on each catch member 70-72, 75, 76 so as to snap into a locking position as represented in FIGS. 8 and 11. At the same time, hook elements 90 and 91, as well as hook members 96 and 97, engage with rear wall 47 as also shown in FIG. 11.

In accordance with another aspect of the invention, rear wall 47 is provided with a pair of mounting members 101 and 102 for attaching utensil holder 38 to inner liner 24. More specifically, each of mounting members 101 and 102 are keyhole like openings having a corresponding enlarged opening portion 103, 104 and a small, arcuate open portion 105, 106 that provide for a positive mounting arrangement for utensil holder 38 as will be detailed more fully below.

In further accordance with the present invention, utensil holder 38 is provided with a handle 108 that enables a consumer to readily remove basket 38 from dishwasher 2. Thus, handle 108 includes first and second upstanding portions 110 and 111 that project from rear wall 47 and are interconnected by a cross-bar portion 114. Preferably, handle 108 is integrally molded with rear wall 47. In any event, in order to provide a more ergonomic handle and enable the consumer to easily grasp handle 108 when basket 38 is mounted to inner liner 24, cross-bar portion 114 includes first and second angled sections 116, 117 that lead to a off-set gripping section 119.

Figure 2:
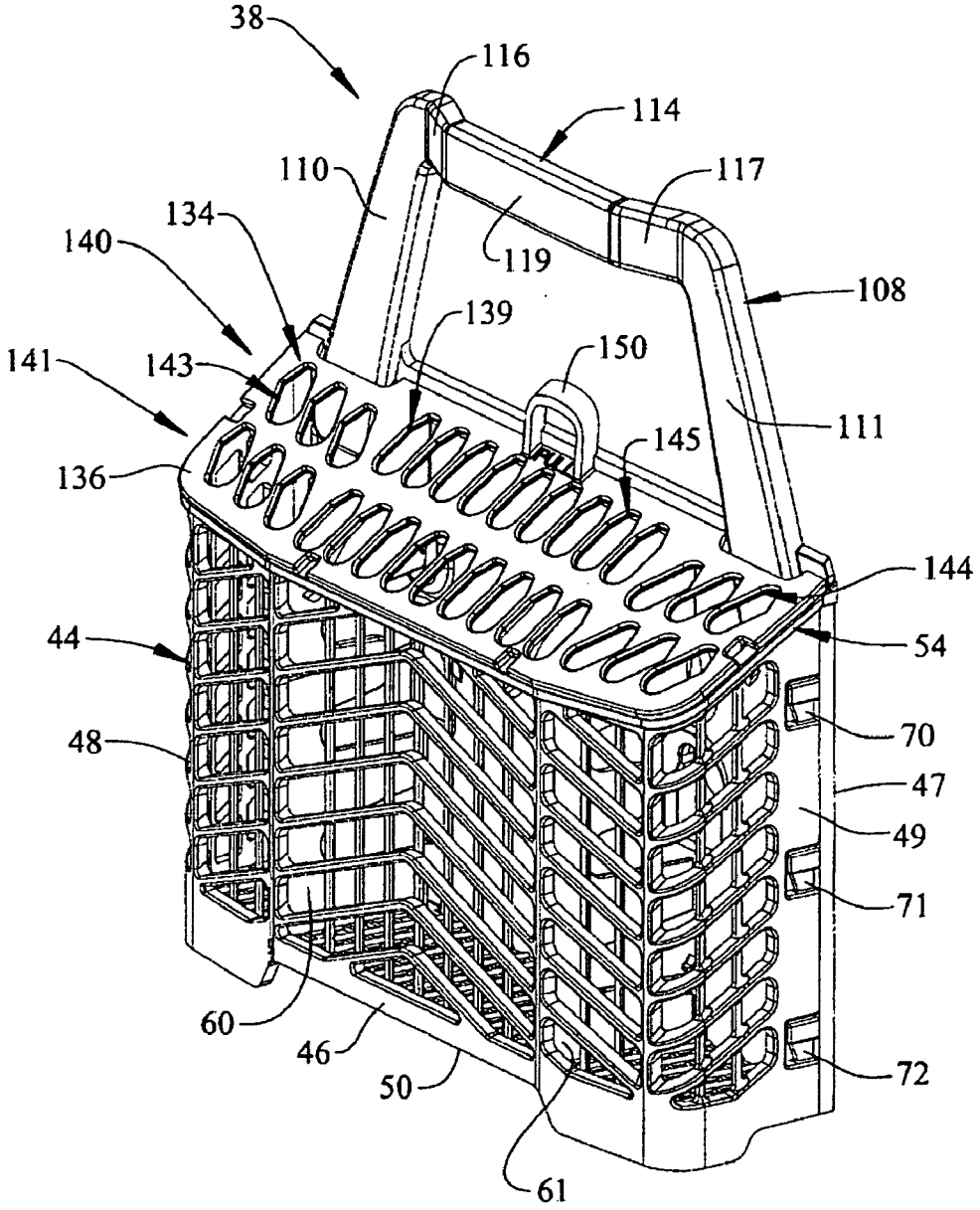
FIG. 2 is an upper right perspective view of the utensil holder constructed in accordance with the present invention.
Figure 3:
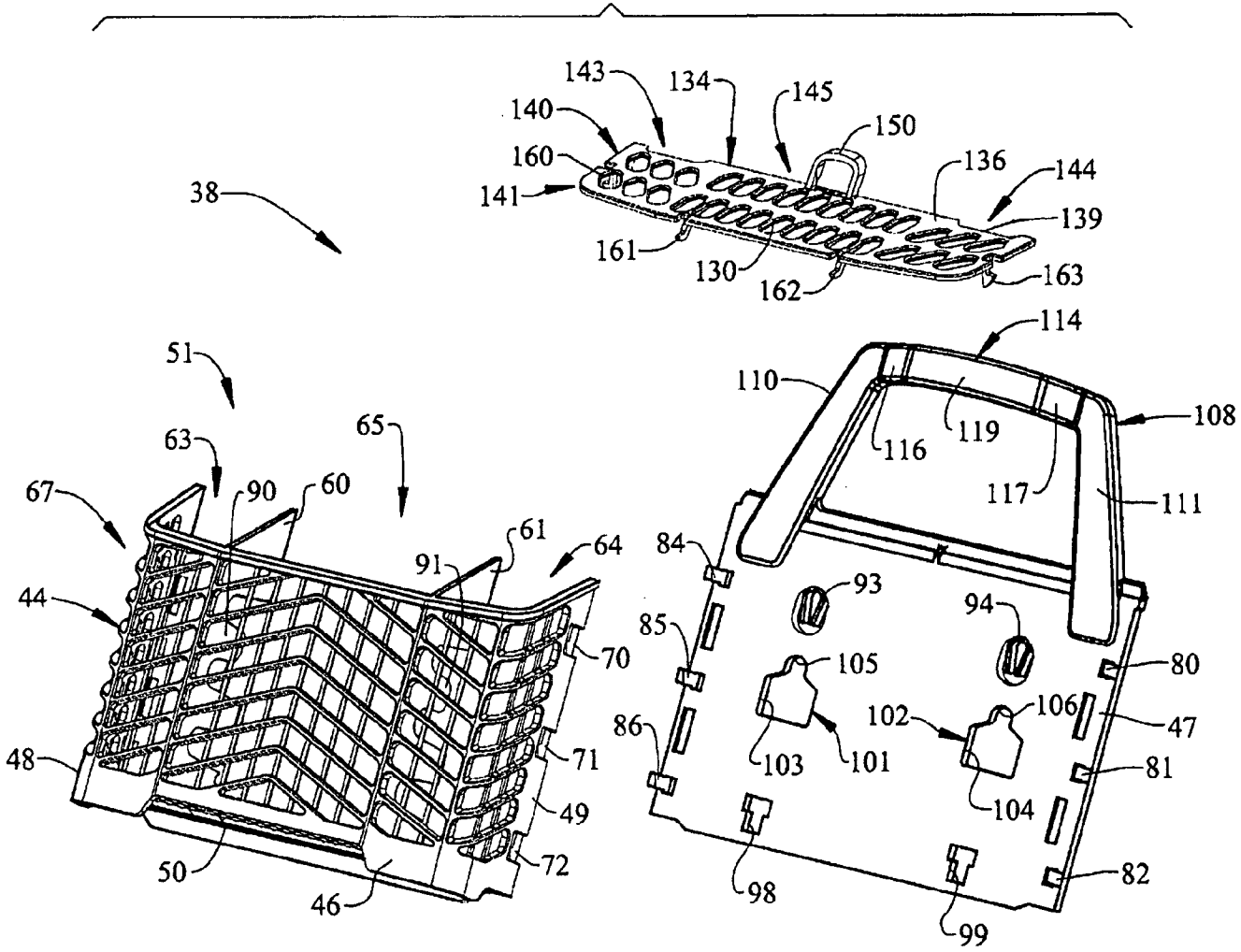
FIG. 3 is an exploded view of the utensil holder of FIG. 2.
Figure 5:
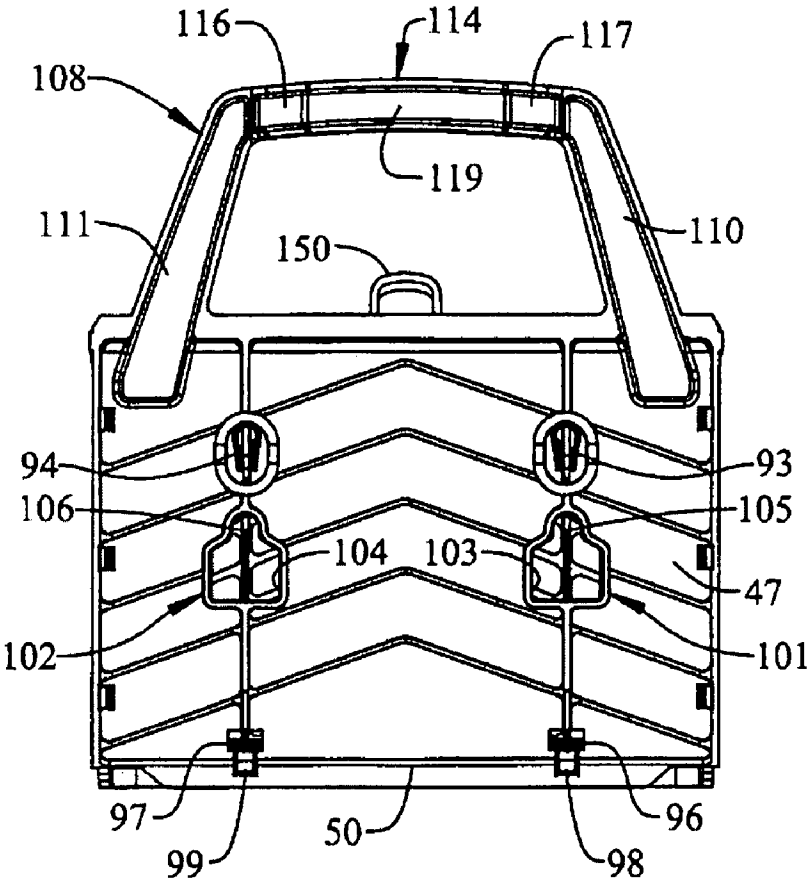
FIG. 5 is a rear elevational view of the utensil holder of FIG. 2.
Figure 4:
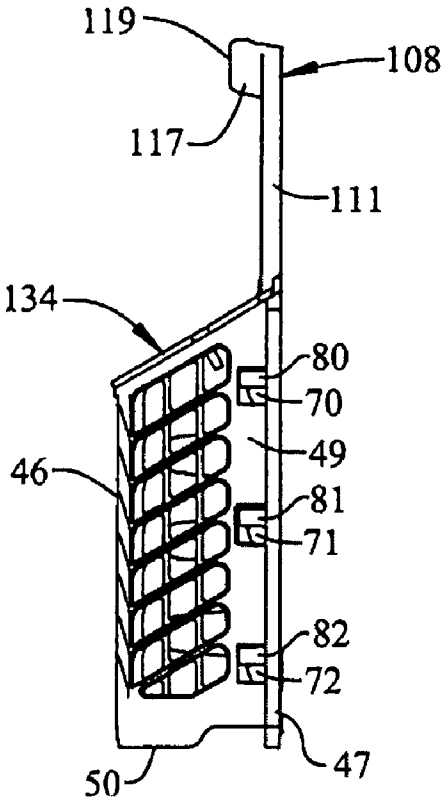
FIG. 4 is a left side elevational view of the utensil holder of FIG. 2.

In still further accordance with the present invention, utensil holder 38 includes a lid member 134 having an upper support surface 136. As best shown in FIGS. 2 and 3, upper support surface 136 is provided with a plurality of openings 139 for receiving utensils and the like that, in accordance with the most preferred form of the invention, are generally arranged in first and second rows 140 and 141. Preferably, openings 139 are constituted by elongated slots that enable lid member 134 to accommodate a wide variety of utensil styles. As lid member 134 extends across opening 51, support surface 136 actually slopes downward. With this arrangement, utensils placed within row 140 actually sit higher than those placed in row 141. Thus, washing fluid will uniformly impact the utensils to more efficiently perform a cleaning operation.

In any event, openings 139 are arranged in zones that correspond to the compartments 63-65 in basket assembly 67. That is, openings 139 are arranged in first and second outer zones 143 and 144, as well as a center zone 145. As best shown in FIG. 2, openings 139 in outer zones 143 and 144 are actually slightly angled as compared to openings 139 arranged within center zone 145 to position the utensils in such a manner so as to provide maximum exposure to the washing fluid. As further shown, lid member 134 is provided with a pull handle 150. Pull handle 150 allows a consumer to readily remove lid member 134 from utensil holder 38 if so desired. Lid member 134 is actually snap-fit to utensil holder 38 through a plurality of clip elements 160 through 163 that are adapted to engage with the open lattice work of front wall 46 and side walls 48 and 49.

Figure 12:
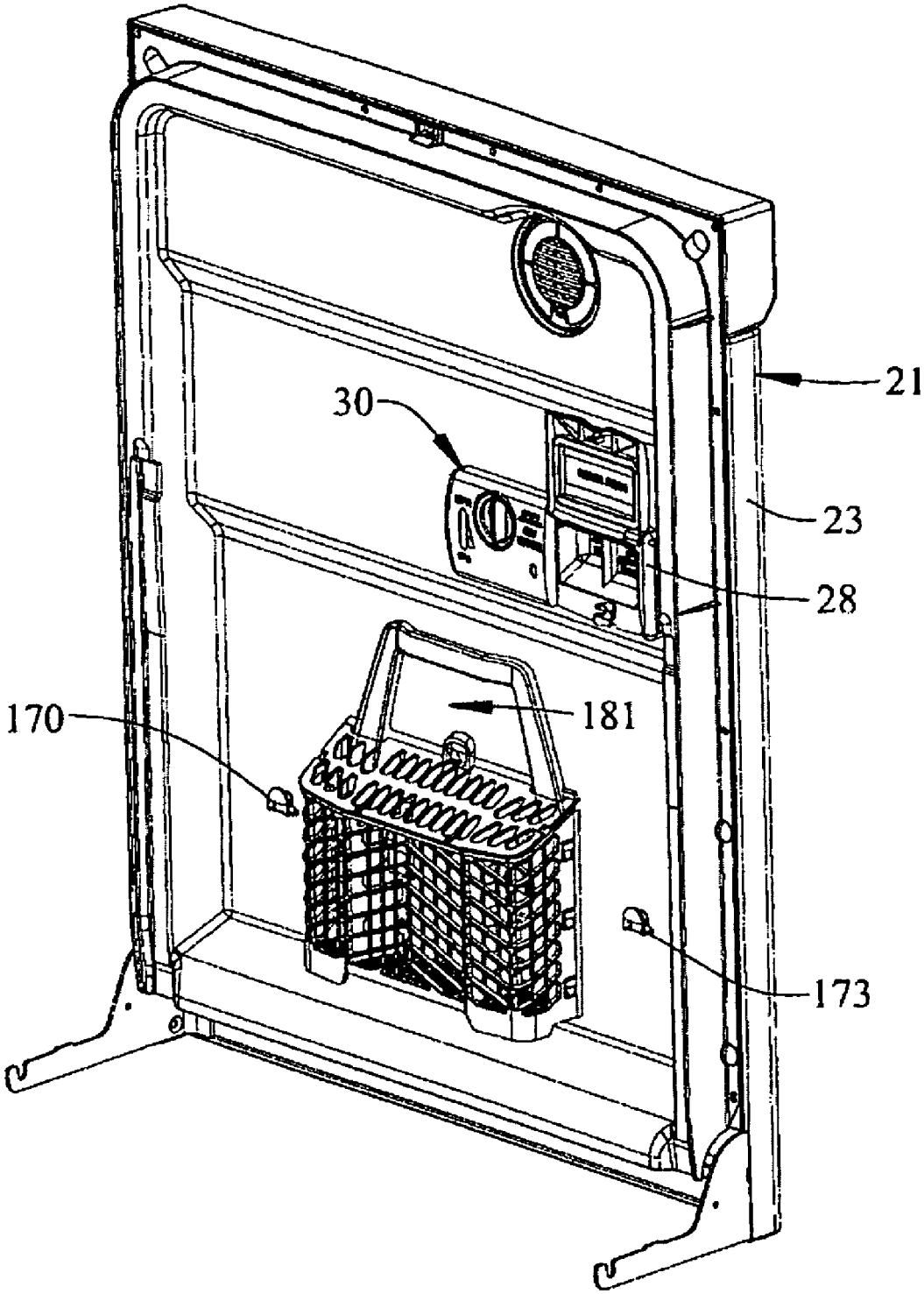
FIG. 12 is an upper right perspective view of a door of the dishwasher, illustrating the utensil holder mounted in a central mounting zone on an inner liner of the door.
Figure 13:
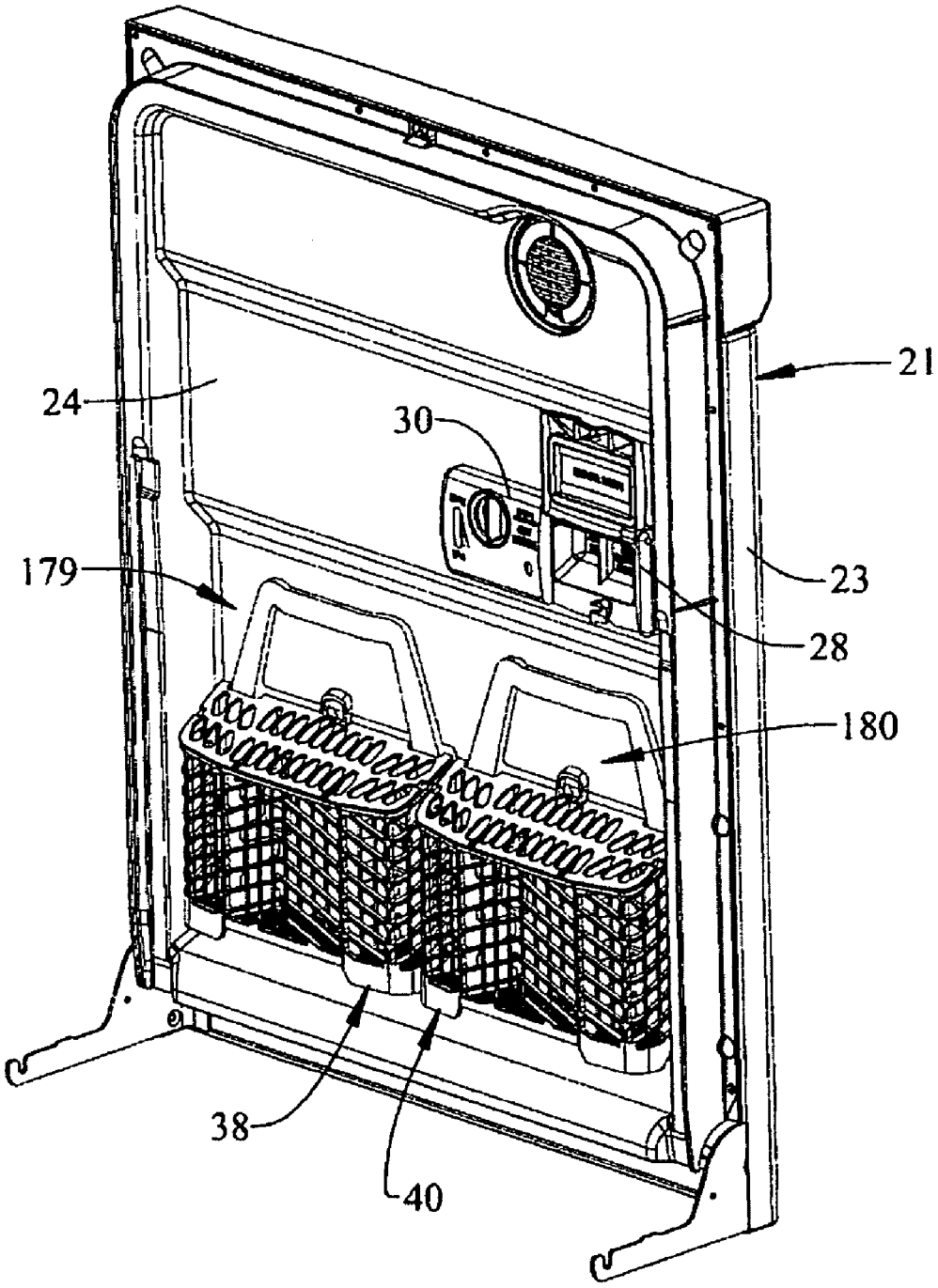
FIG. 13 is an upper right perspective view of the door of FIG. 12 illustrating two utensil holders mounted to the inner liner of the door.

In accordance with the invention, utensil holder 38 can be positioned in a variety of locations within dishwasher 2. As best shown in FIG. 1, utensil holder(s) 38 and/or 40 can be mounted to door 21 or supported within rack 18. Toward that end, door 21 is provided with a plurality of pegs 170, 171 and 173, as well as a fourth peg (not shown) that are adapted to engage rear wall 47 through mounting members 101 and 102. More specifically, utensil holder 38 is mounted on inner liner 24 by positioning enlarged portions 103, 104 of openings 101 and 102 over pegs, for example 170 and 171. At this point, utensil holder 38 is shifted downward such that smaller, arcuate portions 105, 106 of openings 101 and 102 rest upon, and lock onto pegs 170 and 171. To remove the utensil holder from the inner liner, the above process is simply reversed. However, in order to facilitate the removal of utensil holder(s) 38 and/or 40, off-set gripping section 119 allows a consumer to readily access and grasp handle 108. Pegs 170-173 are arranged so as to establish a plurality of mounting zones on inner liner 24. That is, utensil holder 38 can be selectively mounted in a left mounting zone 179 (FIG. 1), a right mounting zone 180 (FIG. 13) or in a central mounting zone 181 (FIG. 12). Moreover, both utensil holders 38 and 40 can be mounted side-by-side on inner liner 24 as represented in FIG. 13. With this overall arrangement, a consumer can readily vary the location of utensil holders 38 and 40. For instance, if more space is required on rack 18 to accommodate larger items, both utensil holders 38 and 40 can be mounted to door 21. Otherwise, the consumer can arrange utensil holders 38 and 40 in any one of various positions.

Although described with reference to a preferred embodiment of the present invention, it should be readily apparent to one of ordinary skill in the art that various changes and/or modifications can be made to the invention without departing from the spirit thereof. For instance, while the utensil basket is described as being formed from multiple, interconnected individual pieces, the basket could be formed as a single, integrally molded unit. In addition, the number of rows and shape of the openings provided on the lid member are for exemplary purposes only as other configurations could also be readily employed without departing from the scope of the present invention. Furthermore, additional interconnecting arrangements for the separately molded parts of the utensil holder could be employed. In general, the invention is only intended to be limited by the scope of the following claims.

We claim:

1. A dishwasher comprising:

a tub having top, bottom, rear and opposing side walls that collectively define a wash chamber having a frontal opening;

a door extending across the frontal opening, said door including an outer shell and an inner liner, said inner liner being provided with a plurality of mounting elements that define left, right and center mounting zones;

a rack shiftably mounted in the wash chamber; and a utensil holder including:

a removable basket including front, rear, bottom and opposing side walls and an upper opening, said basket being adapted to be removably mounted on a select one of the inner liner of the door and the rack and wherein the rear wall of the basket includes at least one mounting member, said mounting member being adapted to interengage with at least a select one of the plurality of mounting elements in order to locate the utensil holder on the inner liner of the door;

a handle member extending from the basket, wherein the handle member enables the utensil holder to be readily picked off both the inner liner of the door and the rack; and wherein the basket is selectively mountable in one of the left, right and center mounting zones through the at least one mounting member and the plurality of mounting elements.

2. The dishwasher according to claim 1, wherein each of the front, bottom and opposing side walls of the basket is constituted by a lattice work.

3. The dishwasher according to claim 1, wherein the front, bottom and opposing side walls of the basket are integrally formed, said side walls including a plurality of catch members.

4. The dishwasher according to claim 3, further comprising: a plurality of dividers arranged within the basket.

5. The dishwasher according to claim 3, wherein the rear wall of the basket includes a plurality of tab elements which engage with the plurality of catch members on the side walls of the basket in forming the basket.

6. The dishwasher according to claim 1, wherein the mounting member is constituted by a keyhole opening.

7. The dishwasher according to claim 1, wherein the mounting elements on the inner liner constitute a plurality of pegs that project substantially perpendicularly outward from the door.

8. The dishwasher according to claim 7, wherein the plurality of pegs constitute four posts arranged on the inner liner, said four posts defining the right, left and central zones.

9. The dishwasher according to claim 8, wherein the at least one mounting member is adapted to engage with a select one of the plurality of pegs to secure the utensil holder to the inner liner.

10. The utensil holder according to claim 9, further comprising: an additional basket, said additional basket being adapted to be supported on the inner liner of the door.

11. The dishwasher according to claim 1, further comprising: a lid member snap-fittingly secured about the upper opening, said lid member having a support surface that slopes from the rear wall toward the front wall, said support surface being provided with a plurality of openings for receiving utensils and a handle positioned on a central, rear portion of the support surface.

12. The dishwasher according to claim 11, wherein the plurality of openings are constituted by elongated slots formed in the support surface.

13. The dishwasher according to claim 12, wherein the plurality of openings in the lid member are arranged in a plurality of rows extending longitudinally across the support surface.

14. The dishwasher according to claim 13, wherein the plurality of rows are constituted by two rows.

15. The dishwasher according to claim 13, wherein the plurality of openings are arranged in a plurality of zones spaced across the lid member.

16. The dishwasher according to claim 15, wherein the plurality of zones are constituted by three zones, a first outer zone, a second outer zone and a central zone.

17. The dishwasher according to claim 16, wherein the plurality of openings in each of the first and second outer zones are angled relative to the plurality of openings in the central zone.

18. The dishwasher according to claim 16, further comprising: first and second dividers separating the basket into a plurality of regions that correspond to the plurality of zones on the lid member.

19. The dishwasher according to claim 11, wherein the lid member is provided with a plurality of clips for removably attaching the lid member to the basket.

20. The dishwasher according to claim 19, wherein the plurality of clips are constituted by hooks that engage with the front and opposing side walls.

21. The dishwasher according to claim 1, wherein the handle member includes first and second upstanding portions interconnected through a cross bar portion, said cross bar portion having first and second angled sections that lead away from the rear wall towards the front wall of the basket to establish an offset to a gripping section.

22. The dishwasher according to claim 21, wherein the first and second upstanding portions are integrally formed with the rear wall.

* * * * *